US006289033B1

(12) United States Patent
Tipton et al.

(10) Patent No.: US 6,289,033 B1
(45) Date of Patent: Sep. 11, 2001

(54) ENVIRONMENTALLY CONTROLLED INDUCTION HEATING SYSTEM FOR HEAT TREATING METAL BILLETS

(75) Inventors: Bryan P. Tipton, Johnstown; Russell S. Corrente, Portage, both of PA (US); Chris C. Alexion, Baltimore, MD (US); Mark C. Waterbury, Johnstown; Thomas P. Creeden, Windber, both of PA (US)

(73) Assignee: Concurrent Technologies Corporation, Johnstown, PA (US)

( * ) Notice: Subject to any disclaimer, the term of this patent is extended or adjusted under 35 U.S.C. 154(b) by 0 days.

(21) Appl. No.: 09/206,332

(22) Filed: Dec. 8, 1998

(51) Int. Cl.[7] ..... H05B 11/00

(52) U.S. Cl. ..... 373/7; 219/651; 373/8; 373/141

(58) Field of Search ..... 373/7, 138, 139, 373/140, 141, 142, 145; 219/651, 653, 647, 654, 655, 656, 658, 770

(56) References Cited

U.S. PATENT DOCUMENTS

| | | | | |
|---|---|---|---|---|
| 3,404,874 | | 10/1968 | Wynne . | |
| 3,580,555 | | 5/1971 | Gearhart . | |
| 3,775,091 | | 11/1973 | Clites et al. . | |
| 4,160,891 | * | 7/1979 | Scheffler | 219/653 |
| 4,332,553 | * | 6/1982 | Earle et al. | 373/141 |
| 4,718,940 | | 1/1988 | McPhillips . | |
| 4,720,615 | * | 1/1988 | Dunn | 219/651 |
| 4,738,713 | | 4/1988 | Stickle et al. . | |
| 4,838,933 | | 6/1989 | Paillere et al. . | |
| 4,948,423 | | 8/1990 | Fetcenko et al. . | |
| 5,090,022 | | 2/1992 | Mortimer . | |
| 5,109,389 | | 4/1992 | Stenzel . | |
| 5,404,929 | | 4/1995 | Till . | |
| 5,554,836 | | 9/1996 | Stanescu et al. . | |
| 5,641,423 | * | 6/1997 | Bridges et al. | 219/770 |
| 5,705,794 | | 1/1998 | Gillespie et al. . | |
| 5,753,004 | * | 5/1998 | Hanai et al. | 373/7 |

* cited by examiner

*Primary Examiner*—Tu Ba Hoang
(74) *Attorney, Agent, or Firm*—Draughon P.A.; Mark J. Young; Mayen E. Jreisat

(57) ABSTRACT

An environmentally controlled heating system for heating metal alloy billets wherein a trolley system carries the billets through the chambers of the induction heating system in crucibles that are pushed or pulled by actuators. The billets enter the system through a load-chamber and travel through a main chamber to a heating area where the loaded crucibles pass through a series of induction heating coils. The heated billets leave the heating area through a dump-chamber where they are delivered to a forming system. The empty crucibles reenter the main chamber and travel back to the loading area to receive another billet. The heating system is controlled through a computing device for monitoring and controlling the system, preferably a programmable logic controller. A vacuum system evacuates air from the chambers, and an inert gas system back-fills the chambers with an inert gas. A gettering system continually cleans the inert gas. Vacuum gates around the load and dump chambers isolate the induction heating system from ambient air and allow for air evacuation and back-filling of the load and dump chambers with the inert gas whenever a billet enters or leaves the induction heating system.

16 Claims, 10 Drawing Sheets

ENVIRONMENTALLY CONTROLLED INDUCTION HEATING SYSTEM FOR HEAT TREATING METAL BILLETS

BACKGROUND

Reactive metals such as titanium, zirconium, hafnium, molybdenum, chromium, niobium, high-temperature nickel-based super alloys, and other metals exhibit an intensive affinity towards oxygen and nitrogen, particularly when heated. In fact, titanium shows such an extreme affinity to oxygen that it is often employed as an oxygen "getter." When heating such metals and metal alloys for forming purposes, it is therefore necessary to do so under an atmosphere free of oxygen and nitrogen.

The metallurgical art has for some time recognized the desirability of utilizing induction heating methods for the melting of reactive metals, such as titanium, as a replacement for known industrial-scale melting processes based on, for example, consumable electrode arc-melting techniques. In induction melting, an electric current is induced into the metal to be melted. Thus, by supplying an alternating current to a primary induction coil, a reverse alternating current is induced into any electrical conductor lying within the magnetic field of the coil, producing heating in the conductor.

Typical induction heating processes are carried out in an oxygen-containing environment such as air. The presence of oxygen results in the formation of scale on the heated metal parts. Scale is an abrasive, which significantly contributes to the wearing of the forming dies, reducing their useful life.

There have been prior efforts to introduce an inert gas into the enclosures of various induction-heating apparatuses to eliminate, or at least substantially reduce, the presence of oxygen. In induction-heating apparatuses, where the induction coils and molten metal are contained in separate housings, a cover has been placed over the space between the housings to provide an airtight enclosure. Multiple inlets have been provided in the cover to transport an inert gas from a source into the pathway contained within the cover. The inert gas then diffuses into the housing to provide a more acceptable gaseous environment for induction heating and subsequent forming.

Disadvantages of such induction systems include lack of control of the injection of the inert gas and the inability to provide a barrier against the infiltration of unwanted gases, such as air, due to drafting. More specifically, induction-heating devices never achieve complete protection against air leaks. For example, it is known that air enters the induction heating apparatus though the entryway where the cold metal parts enter the apparatus and the exit where the heated parts leave the apparatus. In addition, air leaks may be present where the cover is attached to the housing of the induction heating apparatus. The infiltration of such air into the heating areas produces scaling.

Thus, there is a need for an induction-heating system capable of heating reactive metals in an environment of inert gas. A system is needed that is capable of eliminating air leaks and drafts associated with the loading and unloading of the metal billets. A significant benefit could be derived from a system capable of controlling the atmosphere and heating rate of reactive metal billets in an heating system.

SUMMARY

The present invention is directed to an environmentally controlled heating system that satisfies these needs. An heating system having features of the present invention comprises a cold-billet load-chamber and means to place metal billets to be heated into the load-chamber. The billets travel through the heating system in ceramic crucibles on a trolley system. A crucible elevator lifts each crucible up from one end of a loading leg to the cold-billet load-chamber to receive the billet from the load-chamber. The loading leg is one of four legs comprising the main chamber. The other three legs include the heating leg, transfer leg, and return leg. The crucible elevator lowers the loaded crucible to the loading leg.

An actuator pushes the crucible through the loading leg to the entrance of the heating leg. An actuator is mounted on each leg of the heating system for advancing the crucible through a series of induction heating coils. When the crucible enters the heating leg, the billet is heated by advancing the crucibles through the heating system. Once the heating process is complete, the crucible leaves the heating leg on a transfer trolley and enters a hot-billet dump-chamber. A crucible dump actuator triggers inversion of the transfer trolley and crucible, thereby delivering the billet to a forming system. The empty crucible then enters the transfer leg and travels through the transfer leg to the return leg. The empty crucible travels through the return leg to the loading leg to receive another billet.

The heating system and the working relation of all subsystems is controlled by a computing device, preferably a programmable logic controller (PLC). The computing device monitors and controls the actuators, and it keeps track of the positions of all billets inside the heating system. The computing device also monitors output signals from an induction heating power supply, as well as signals from safety sensors that provide data to enable the computing device to know when it should shut down the system.

The heating system also comprises an environmental control system for evacuating air from and forcing an inert gas into the heating system. Prior to production startup, the heating system is run through a vacuum pump-down cycle to remove ambient air and other gaseous contaminants from the system. After this vacuum period, the heating system is back-filled with the inert gas. A gettering system mounted on the return leg continually cleans the inert gas, and a blower located between the return leg and the gettering system forces circulation of the gettered gas.

The environment within both the load and dump chambers is cycled for each billet. Each billet enters the cold-billet load-chamber through an outer cold-billet load-chamber vacuum gate. When the outer load gate is closed, a cold-billet load-chamber vacuum pump evacuates air from the load-chamber. After air evacuation, an inner cold-billet load-chamber vacuum gate opens to permit the billet to pass to a crucible and enter the load leg. After the billet has been heated, the loaded crucible moves from the heating leg into the dump-chamber through an inner hot-billet dump-chamber vacuum gate. After this gate closes, an outer hot-billet dump-chamber vacuum gate opens, permitting the billet to leave the dump-chamber when the crucible is inverted. After the outer dump gate closes, a hot-billet dump-chamber vacuum pump evacuates air from the dump chamber. After air evacuation, the inner dump gate opens, allowing the empty crucible to return to the main chamber.

BRIEF DESCRIPTION OF THE DRAWINGS

These and other features, aspects, and advantages of the present invention will become better understood with regard to the following description, appended claims, and accompanying drawings where:

DESCRIPTION

The invention summarized above and defined by the enumerated claims may be better understood by referring to the following detailed description, which should be read in conjunction with the accompanying drawings. This detailed description of a particular preferred embodiment, set out below to enable one to build and use one particular implementation of the invention, is not intended to limit the enumerated claims, but to serve as a particular example thereof. The particular example set out below is the preferred specific implementation of the heating system and the method of heating metal billets in the heating system.

In accordance with the preferred implementation of the present invention, the heating system heats metal alloy billets in an inert gas environment to prevent infusion of ambient air and other contaminants into the heated billets. A computing device monitors, controls, and coordinates the heating system subsystems. The major subsystems of the heating system include the following: (a) chambers for passage of the billets; (b) vessels or "crucibles" for carrying the billets; (c) a trolley system for transporting the crucibles; (d) means for moving the crucibles, for example, by being pushed through the heating system; (e) means for receiving the cold billets into the system; (f) means for heating the billets; (g) means for delivering the hot billets to an external device for forming the billets; (h) a vacuum system for evacuating air from the system; (i) an inert gas system for back-filling the chambers with an inert gas; and (j) a gettering system for cleaning the inert gas.

Cold billets enter the heating system by being placed into a load-chamber by a loading means and then being transferred to crucibles for carrying. The crucibles are transported through the heating system on trolleys. Movement of the crucibles occurs by means for pushing or pulling the crucibles through the heating system. The billets are delivered to a heating leg where heating occurs by cycling the billets through a series of induction heating coils. After heating, the heated billets pass out of the heating leg to a dump-chamber containing a means for separating the billets from the crucible, thereby delivering the heated billets to a means for forming the heated billets, and the empty crucibles return to the loading area to receive another billet. The chambers are evacuated of air and back-filled with the inert gas before production operation begins. The load and dump chambers are also evacuated and back-filled as a billet enters or leaves the induction heating system.

Overview

Figure 1:
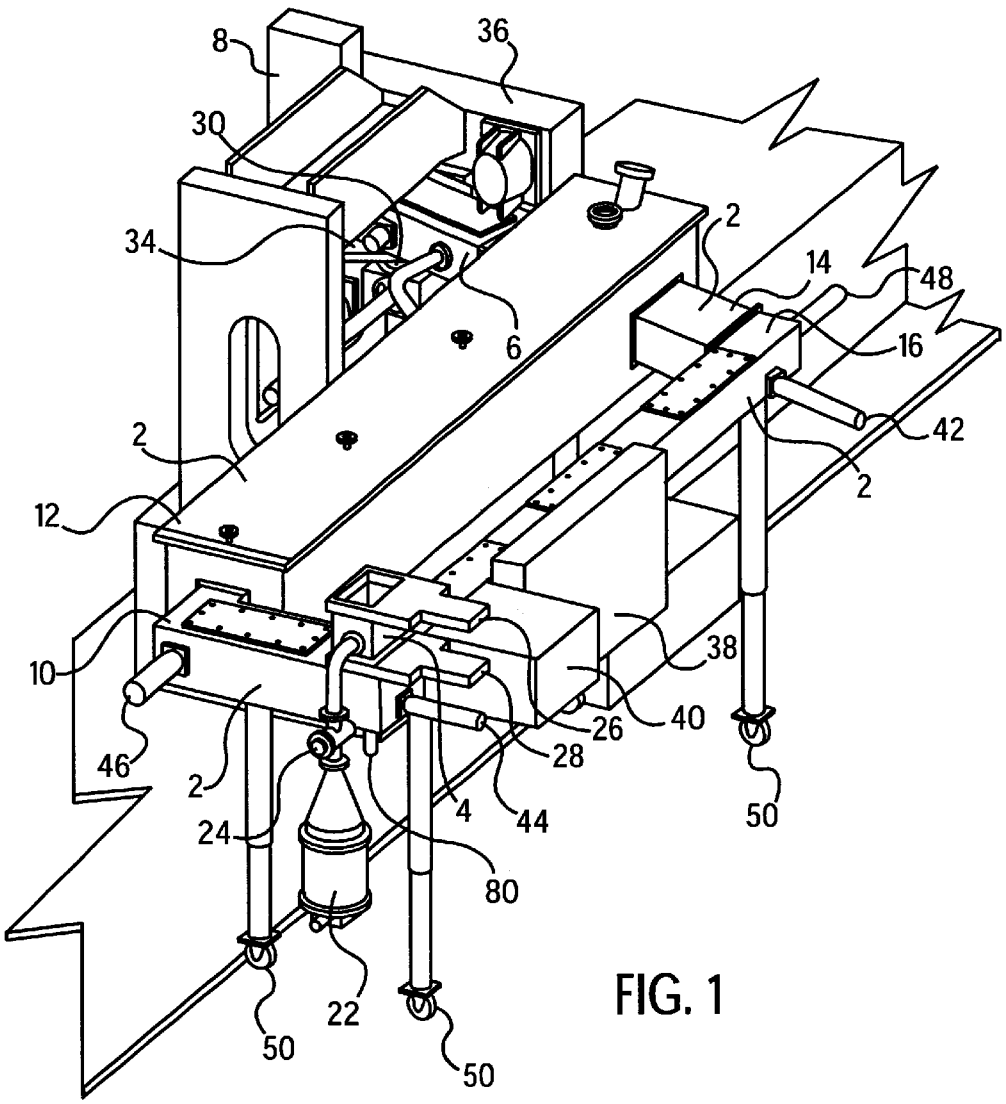
FIG. 1.—Shows a simplified diagram of an environmentally controlled heating system for heating metal billets according to one embodiment of the invention.

The apparatus illustrated in FIG. 1 depicts a preferred embodiment for the heating of high melting temperature reactive alloy billets within an environmentally controlled heating system. The heating system has a computing device (not shown), preferably a programmable logic controller (PLC) for monitoring and controlling the heating system and the working relation of its subsystems. Suitable billet alloys for the heating system include titanium, brass, iron, and aluminum alloys. Titanium alloy is the preferred type of billet alloy. In accordance with one aspect of the present invention, the billets have a diameter of up to approximately four inches, a length of up to about six inches, and a weight up to about 25 pounds.

Figure 2:
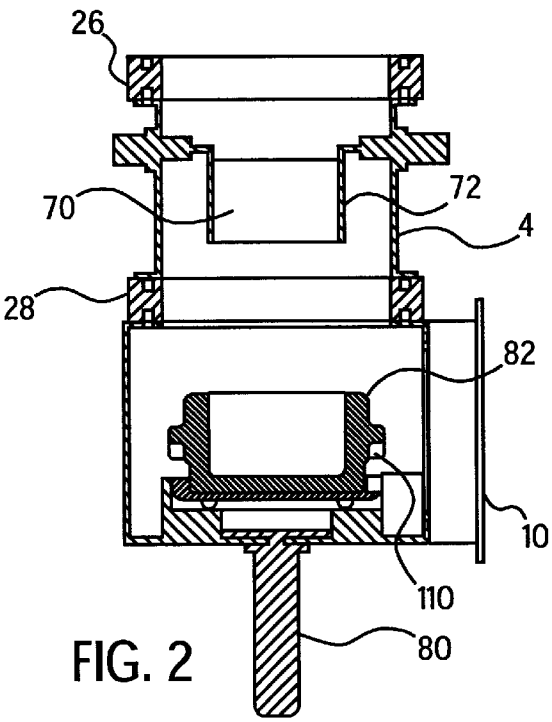
FIG. 2.—Represents a detailed view of a cold-billet load-chamber for use in the heating system of FIG. 1.

The heating system is comprised of several chambers and subsystems, including a vacuum system, a crucible/billet transfer system, an inert gas system 38, and an induction heating system. The embodiment of FIG. 1 shows three chambers comprising a main chamber 2, a cold-billet load-chamber 4 for receiving the billets 70 (see FIG. 2) into the heating system, and a hot-billet dump-chamber 6 for delivering the heated billets 70 to a conventional means for forming the billets 8, preferably a horizontal die casting machine. The main chamber 2 forms a pathway for the billets 70 to travel through the heating system. The main chamber 2 is comprised of four legs. A loading leg 10 is directly adjacent to the load chamber 4 at the entrance of the loading leg 10. The other end of the loading leg 10 joins a heating leg 12 at the entrance of the heating leg 12. The billets 70 are heated within the heating leg 12. The other end of the heating leg 12 joins a transfer leg 14 at the entrance of the transfer leg 14. The other end of the transfer leg 14 joins a return leg 16 at the entrance of the return leg 16. The other end of the return leg 16 joins the entrance of the loading leg 10. The dump-chamber 6 extends from the heating leg 12 to deliver the heated billets 70 to the forming means 8.

A vacuum system evacuates air from the heating system. The vacuum system is comprised of a cold-billet load-chamber vacuum system disposed about the cold-billet load-chamber 4 and a hot-billet dump-chamber vacuum system disposed about the dump-chamber 6. The cold-billet load-chamber vacuum system is comprised of a cold-billet load-chamber vacuum pump 22; a cold-billet load-chamber vacuum pump valve 24 attached to the load-chamber vacuum pump 22; an outer cold-billet load-chamber vacuum gate 26 located on the exterior of the load-chamber 4 that opens to receive a billet 70, exposing the load-chamber 4 to ambient air; and an inner cold-billet load-chamber vacuum gate 28 located on the interior side of the load-chamber 4, separating the load-chamber 4 from the loading leg 10. The hot-billet dump-chamber vacuum system is comprised of a hot-billet dump-chamber vacuum pump 30; a hot-billet dump-chamber vacuum pump valve (not shown) attached to the dump-chamber vacuum pump 30; an outer hot-billet dump-chamber vacuum gate 34 located between the dump-chamber 6 and the forming means 8 that opens to deliver a billet 70 to the forming means 8, exposing the dump-chamber 6 to ambient air; and an inner hot-billet dump-chamber vacuum gate 36 located on the interior side of the dump-chamber 6, separating the dump-chamber 6 from the heating leg 12. An inert gas system 38 adjacent to the main chamber 2 introduces an inert gas into the heating system, and a gettering system 40 adjacent to the return leg 16 continuously cleans the inert gas.

Prior to production startup, the heating system is run through a vacuum pump-down cycle to remove oxygen, nitrogen, and other ambient air and gaseous contaminants from the heating system. In the preferred system, the load-chamber 4 and dump-chamber 6 are sufficiently sealed, for example, by gaskets, to allow vacuum operation down to a pressure of $1\times10^{-4}$ torr or lower. The entrance and exit of the load-chamber 4 and dump-chamber 6 are closed using the vacuum gates. The gates are preferably solenoid-actuated and pneumatic-assisted. The heating system is pumped down to a vacuum level of preferably $1\times10^{-3}$ torr pressure or lower. This vacuum level is maintained until out-gas is complete, which lasts at least one hour. Then the inert gas, preferably argon gas, is introduced into the main chamber 2 through the gettering system 40 and allowed to circulate within the chambers for at least 30 minutes. A flow of approximately 40 l/min is maintained during the initial purge. The pressure in the main chamber 2 is increased to a typical value of approximately 0.1 psig (14.8 psia). A blower (not shown) located between the return leg 16 and the gettering system 40 continually circulates the inert gas through the induction heating system.

During production operation, the load-chamber vacuum pump 22 and the dump-chamber vacuum pump 30 run at all times, and the pressure in the main chamber 2 is maintained at about 0.1 psig. The environment within both the load-chamber 4 and dump-chamber 6 is cycled as each billet 70 enters or leaves the induction heating system. After the load-chamber 4 and dump-chamber 6 are exposed to ambient air, both chambers are evacuated of air and then back-filled with the inert gas to a pressure approximately equal to the pressure in the main chamber 2. During each operating cycle, the pressure inside the load-chamber 4 and dump-chamber 6 drops from 0.1 g pressure (14.8 psia) to approximately $1\times10^{-2}$ torr in a period of about 40 seconds. The load-chamber vacuum pump valve 24 opens for approximately 32 seconds, and the dump-chamber vacuum pump valve opens for approximately 22 seconds during each cycle. Because the inert gas is lost at the outer load and dump gates, a supply of inert gas is continually reapplied to the induction heating system at approximately 4 l/min.

Figure 3:
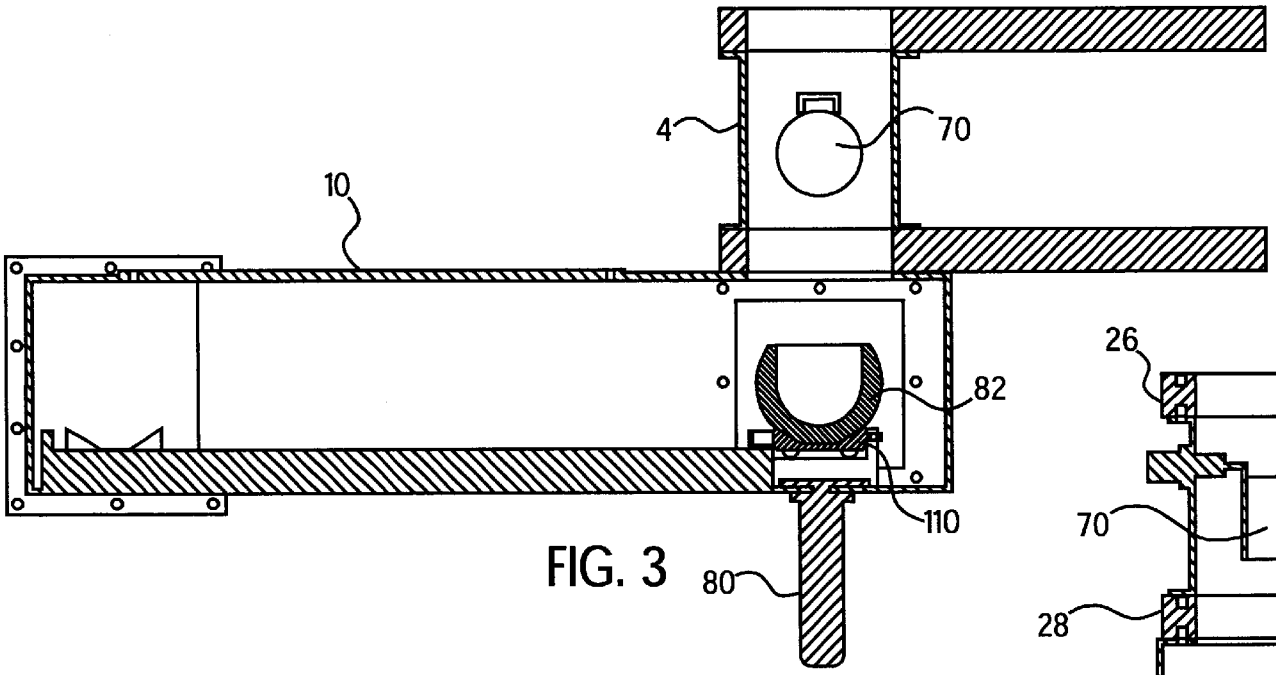
FIG. 3.—Represents another detailed view of the cold-billet load-chamber of FIG. 2.
Figure 20:
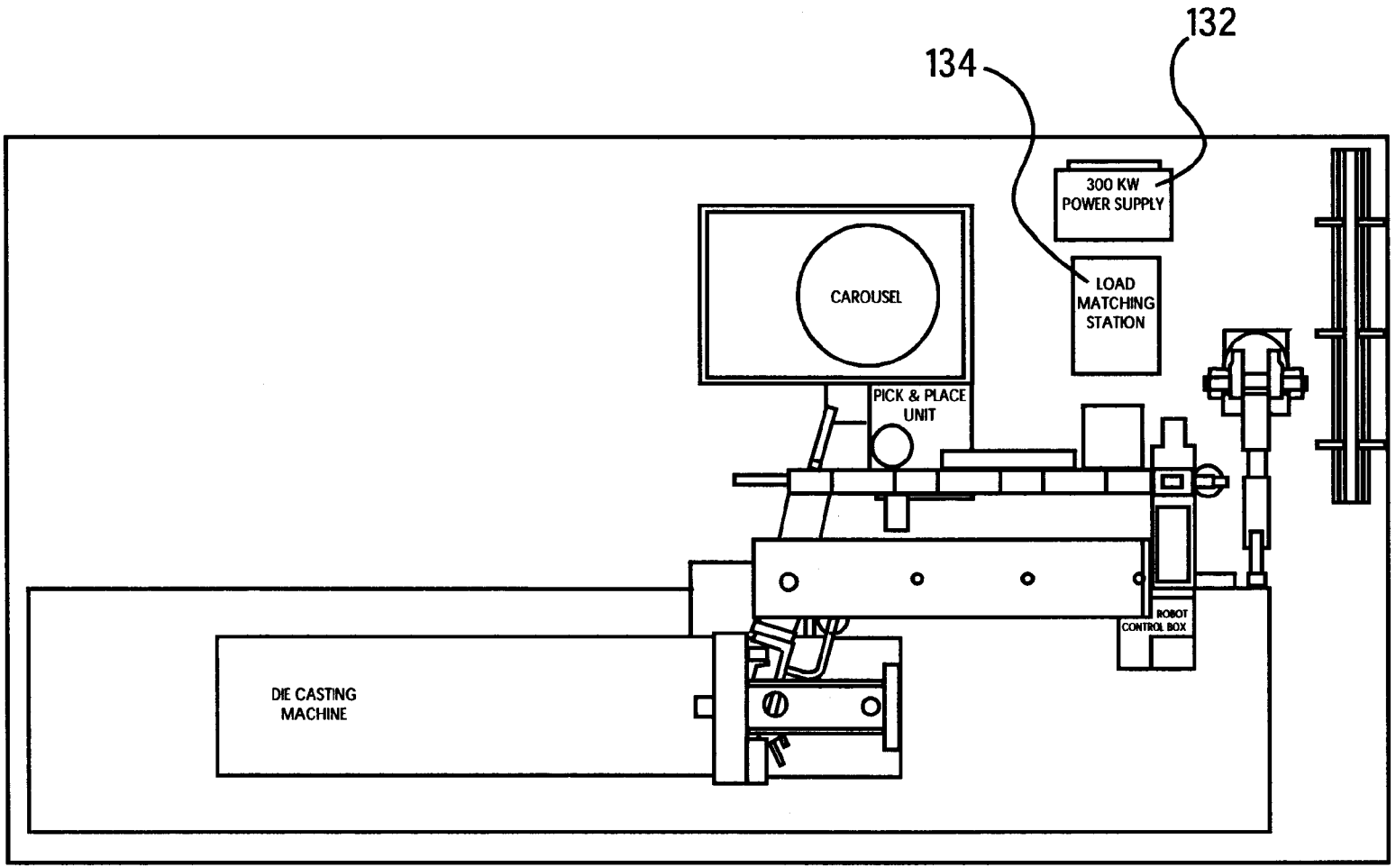
FIG. 20.—Depicts an overhead view of the heating system of FIG. 1.
Figure 21:
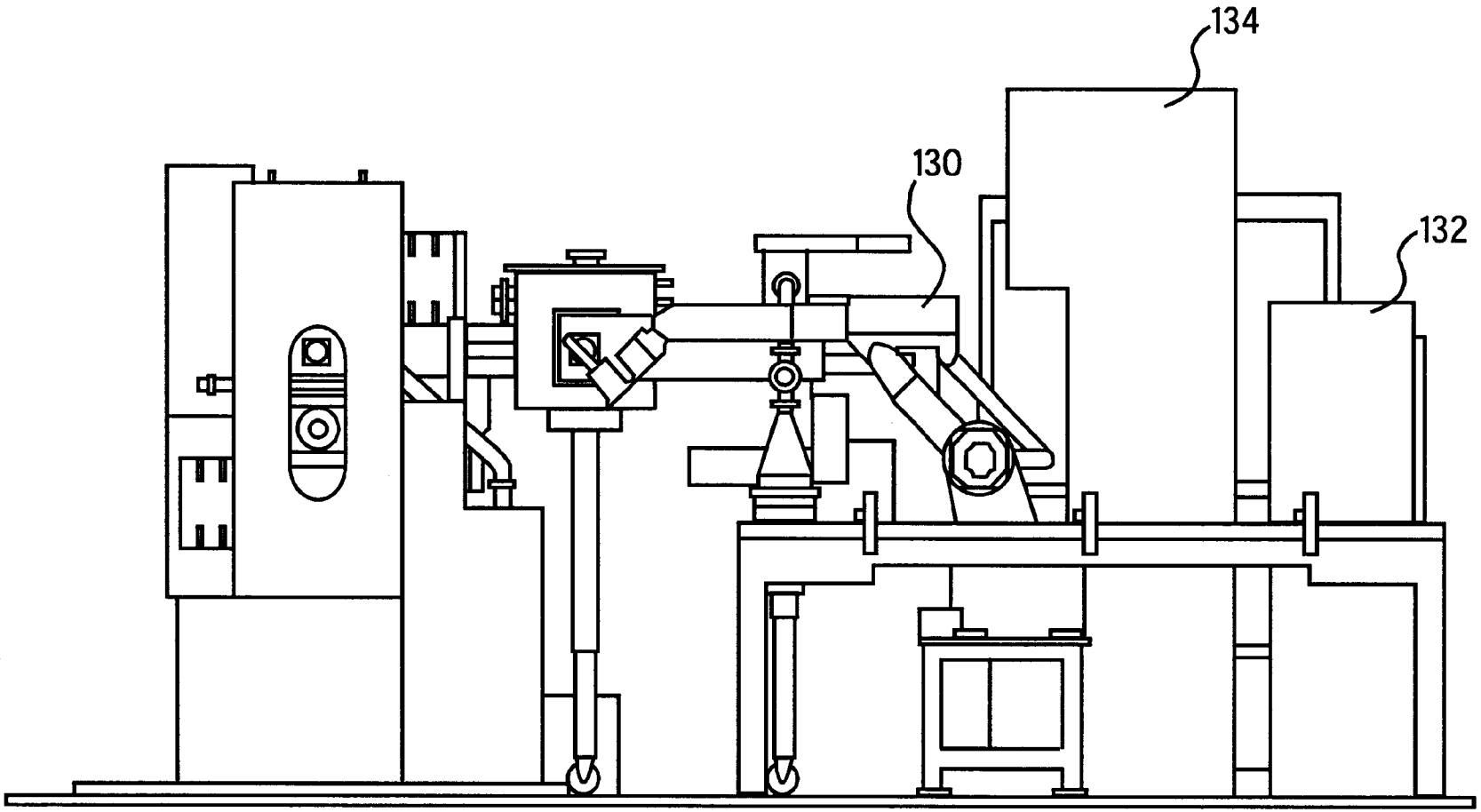
FIG. 21.—Depicts an end view of the heating system of FIG. 1.

In operation, the outer load gate 26 is opened to permit a means for loading the billets to place a cold billet 70 into the load-chamber 4, preferably by use of a robotic arm 130 (see FIGS. 20 and 21). Billet end grips 72 (see FIG. 2) inside the load-chamber 4 are clamped onto the billet 70, and the robotic arm 130 is retracted. The outer load gate 26 is closed and the load-chamber vacuum pump valve 24 is opened. When the load-chamber 4 is evacuated of air, the load-chamber vacuum pump valve 24 is closed. Then the inner load gate 28 is opened to permit a crucible elevator 80 (see FIG. 3) on which an empty crucible 82 (see FIG. 3) rests to rise from the loading leg 10 so that the crucible 82 surrounds the billet 70 and the billet end grips 72 inside the load-chamber 4. The billet end grips 72 retract laterally, gently transferring the billet 70 into the crucible 82. The crucible elevator 80 with the loaded crucible 82 reenters the loading leg 10, and the inner load gate 28 is closed. The crucible elevator 80 is capable of supporting approximately 50 pounds. The vertical elevation stroke of the crucible elevator 80 from the loading leg 10 to the load-chamber 4 is approximately 13 inches. Motion up of the crucible elevator 80 and return to lower resting position occurs within about four seconds.

Figure 5:
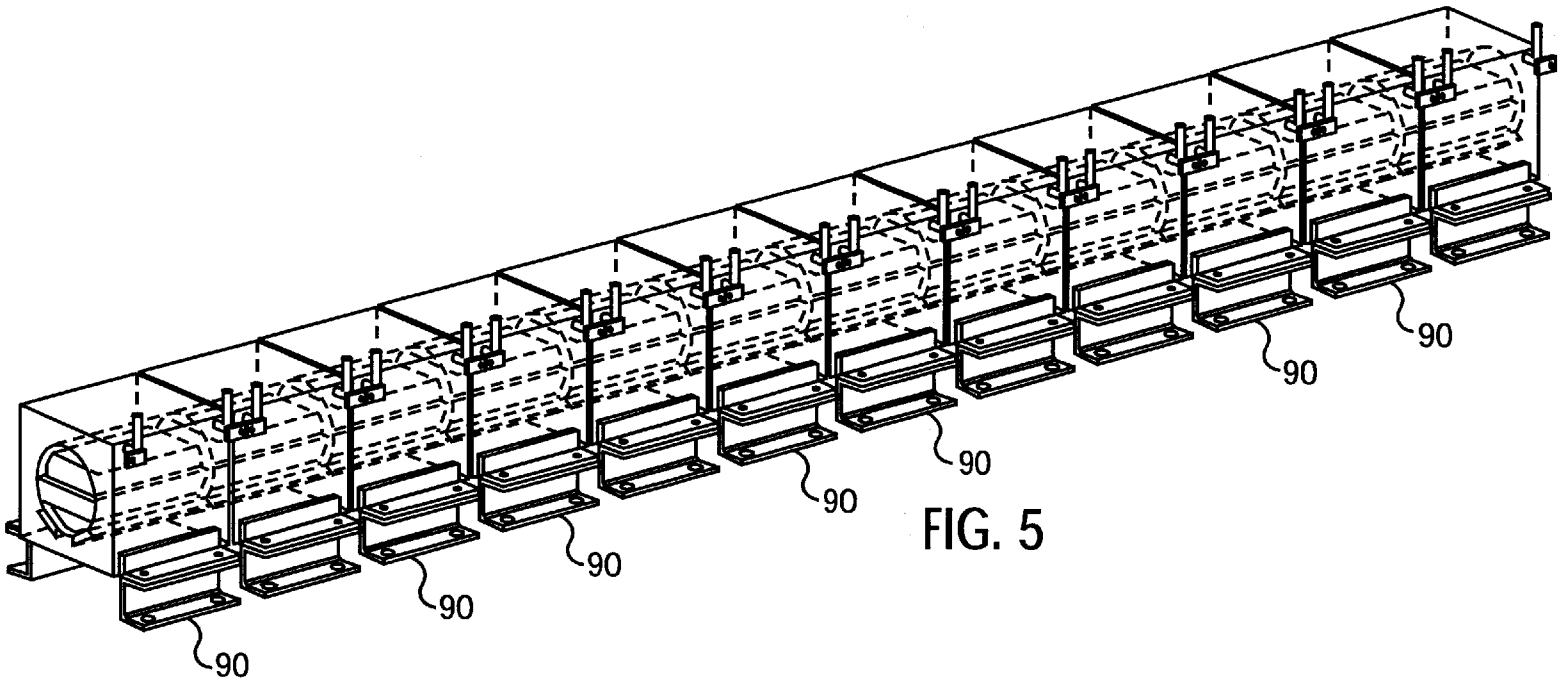
FIG. 5.—Represents a detailed view of an induction heating coil stack for use in the heating system of FIG. 1.
Figure 6:
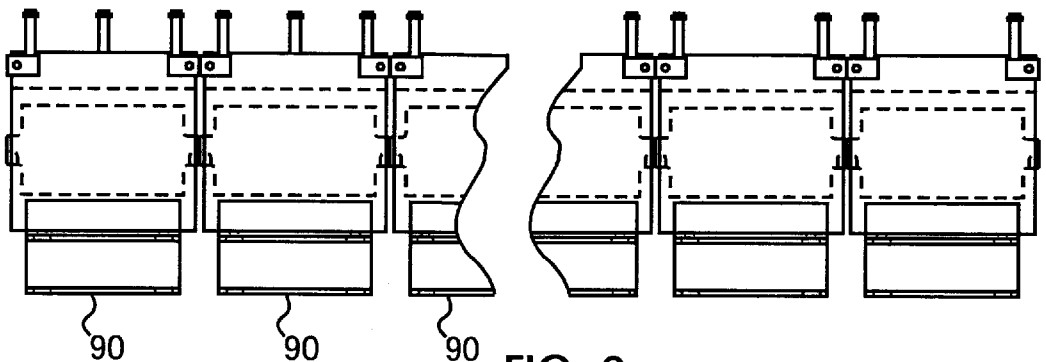
FIG. 6.—Represents another detailed view of the induction heating coil stack of FIG. 5.
Figure 7:
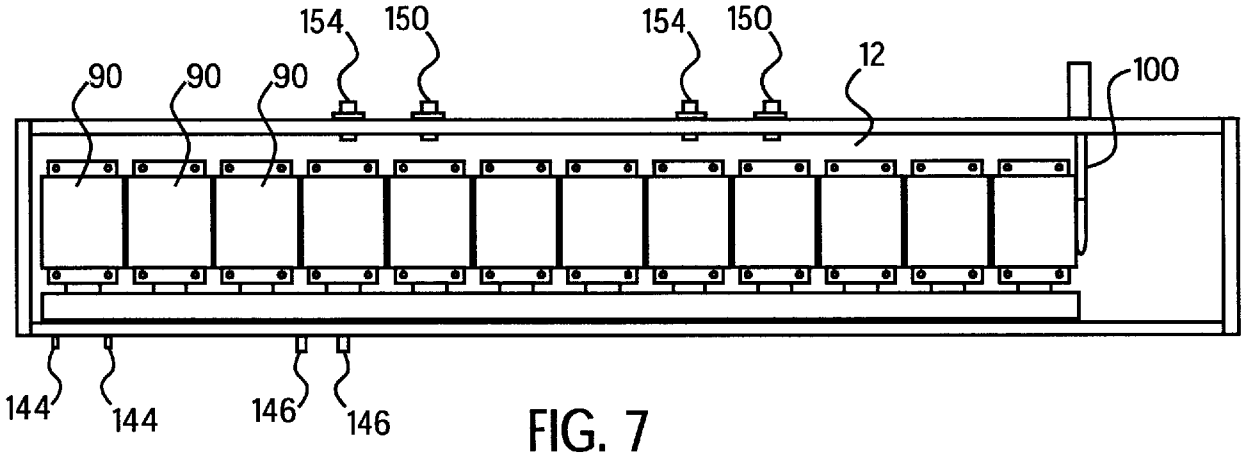
FIG. 7.—Represents a top view of a heating leg for use in the heating system of FIG. 1, including the induction heating coil stack of FIGS. 5 and 6.
Figure 11:
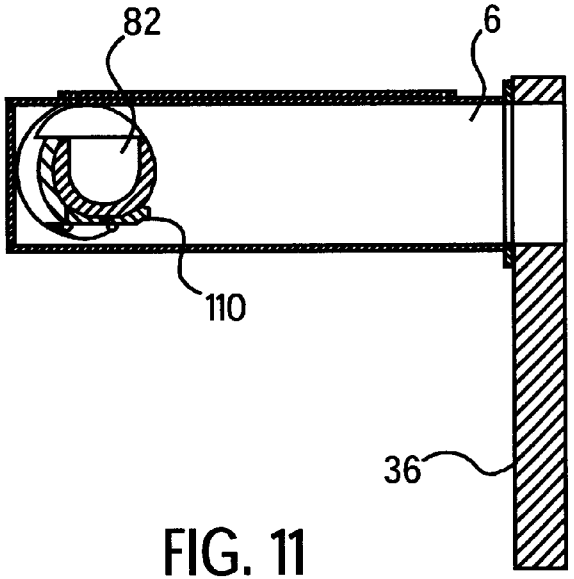
FIG. 11.—Represents a sectional view of a hot-billet dump-chamber for use in the heating system of FIG. 1.
Figure 10:
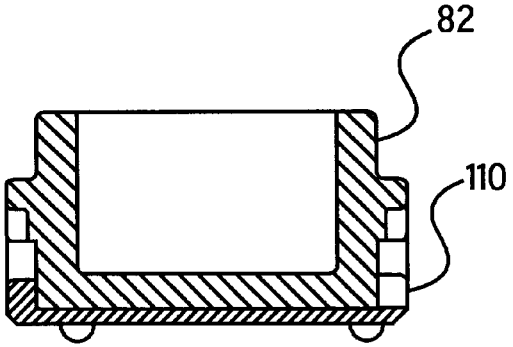
FIG. 10.—Represents a simplified diagram of a transfer trolley and crucible for use in the heating system of FIG. 1.
Figure 12:
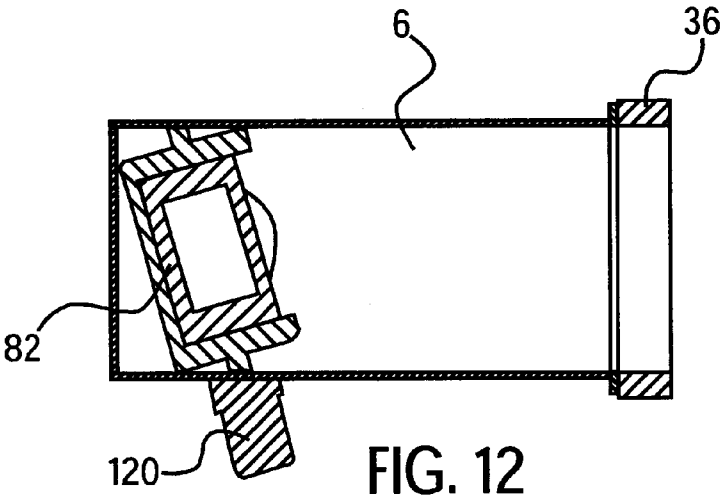
FIG. 12.—Represents another sectional view of the hot-billet dump-chamber of FIG. 11.

The loaded crucible 82 is pushed through the loading leg 10 and into position at the entrance of the heating leg 12. When the current heating cycle finishes, the loaded crucible 82 is pushed into position at the first of a multiple of induction heating coils 90 (see FIG. 5) inside the heating leg 12. Multiple crucibles 82 are lined up within the heating leg 12. In one embodiment of the invention, up to twelve crucibles 82 are lined up in the heating leg 12, each crucible 82 being within one of the induction heating coils 90. Each time the induction heating system completes a cycle, the crucibles 82 are pushed successively through the heating leg 12. At each stop, the billet 70 will dwell for about 45 to 60 seconds to allow for one cycle of induction heating. When the loaded crucible 82 has cycled through each of the induction heating coils 90 and the loaded crucible 82 is at the last induction heating position, a heating leg thermal gate actuator (not shown) opens a thermal gate 100 (see FIG. 7) and the loaded crucible 82 is pushed onto a transfer trolley 110 (see FIG. 10) within the transfer leg 12. The thermal gate 100 is a non-sealing thermal barrier that covers the hot (exit) end of the heating leg 12 to limit heat flow out of the heating leg 12. The thermal gate 100 is exposed to full titanium alloy melt temperatures approaching 1,500° C. The thermal gate 100 is closed, and the inner dump gate 36 is opened, permitting a transfer pusher 42 (see FIG. 1) to attach to the transfer trolley 110 to push the transfer trolley 110 with the loaded crucible 82 into the dump-chamber 6 (see FIG. 11). The transfer pusher 42 is released from the transfer trolley 110 and retracted out of the way of the inner dump gate 36. The inner dump gate 36 is closed and the outer dump vacuum gate is opened. The transfer trolley 110 and the crucible 82 are inverted, delivering the heated billet 70 to the forming means 8 (see FIG. 12). The transfer trolley 110 and the empty crucible 82 are returned to the upright position. The outer dump gate 34 is closed and the dump-chamber vacuum pump valve is opened. When the dump-chamber 6 is evacuated of air, the dump-chamber vacuum pump valve is closed and the inner dump gate 36 is opened. The transfer pusher 42 is moved to the transfer trolley 110, reattached to the transfer trolley 110, and the transfer pusher 42 pulls the transfer trolley 110 back inside the main chamber 2 and through the transfer leg 14 to the entrance of the return leg 16. The empty crucible 82 is pushed within the return leg 16 towards the loading leg 10.

Figure 14:
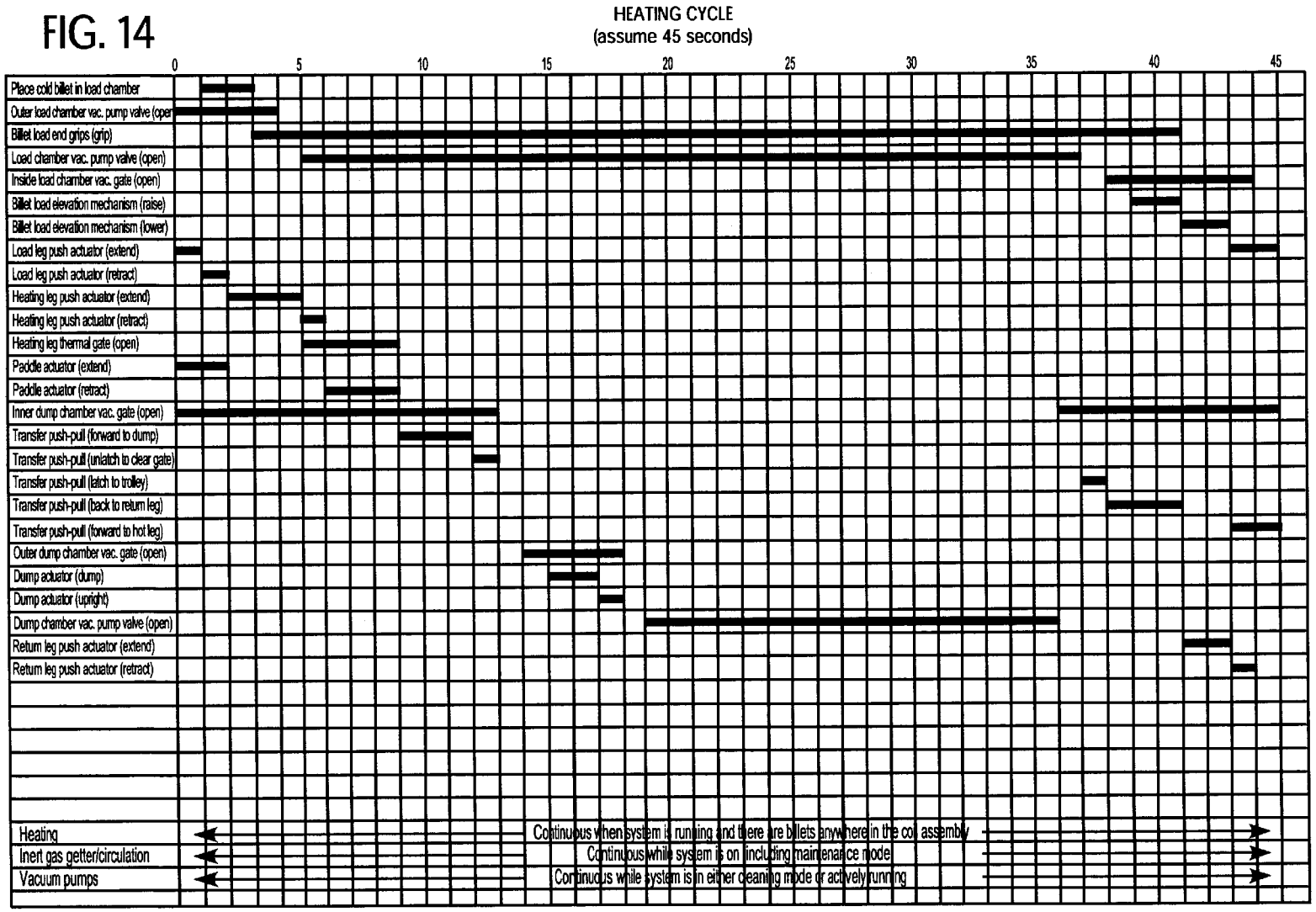
FIG. 14.—Depicts timing of events during one heating cycle for the heating system of FIG. 1.

The heating system contains a full complement of crucibles 82 at all times. In one embodiment of the invention, twelve crucibles 82 are lined up within the heating leg 12, one crucible 82 is being loaded at the load chamber 4, and another crucible 82 is being unloaded from the dump-chamber 6. However, the system may be run in continuous, single, or unload modes. In each mode, the computing device keeps track of positions of all billets 70 and crucibles 82 inside the heating system. When no billet 70 is present in the crucible 82 exiting the heating leg 12, the dumping operation will not occur, and the computing device will not send a signal to the forming means 8 to form a part. In this "empty crucible" condition, the crucible 82 is simply recycled back to the return leg 16. In the continuous mode, the loading means continues to load cold billets 70 into the load-chamber 4 and the forming means 8 continues to form the heated billets 70. Because operation may be continuous, many of the steps described above occur simultaneously, as depicted in the timing diagram in FIG. 14. In the single mode, a single cold billet 70 is loaded into one of the crucibles 82 and started through the heating system, automatically shifting the system into unload mode. Unload mode simply causes any billets 70 remaining within the heating system to be heated and delivered to the forming means 8 until the heating system is empty, and then the system stops.

Crucible/Billet Transfer System

A crucible/billet transfer system moves the crucibles 82 through the heating system. The crucible/billet transfer system is comprised of the crucibles 82, a trolley system for supporting and carrying the crucibles 82, linear actuators that push or pull the crucibles 82, and a crucible dump actuator for inverting the transfer trolley 110. The actuators that cause crucible movement, are driven by electrical means, such as by stepper drive or servo, thereby permitting programmable, precise control of crucible position, velocity, and acceleration through the computing device. This enables accurate motion control and limits mechanical stress to the crucibles 82. Position monitoring of the linear drives is accomplished by linear displacement transducer or rotary shaft encoder/resolver monitoring means. The actuator drives monitor and limit the output force and indicate overload conditions.

Figure 23:
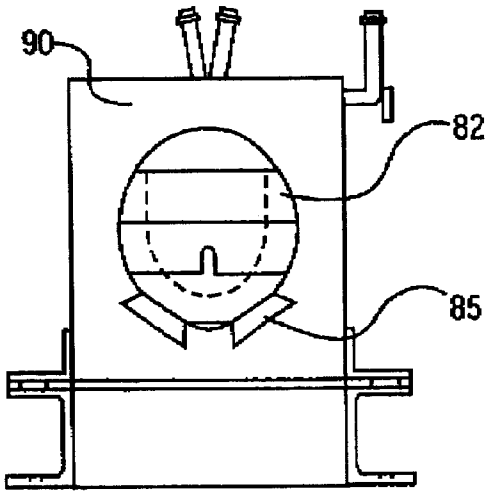
FIG. 23.—Represents another view of the induction heating coil of FIG. 22.

The crucibles 82 are advanced through the heating system on the transfer trolleys 110 primarily by being pushed forward one crucible position at a time. The linear actuators perform the pushing action. However, when passing through the induction heating coils 90 in the heating leg 12, the crucibles 82 move from one induction heating coil 90 to the next by being pushed over crucible slide rails 85 (see FIG. 23). The linear actuator drives are mounted on the exterior of the main chamber 2 and linked through the main chamber 2 walls by magnetic couplings. The actuators that push the crucibles 82 are located on each of the main chamber 2 legs—the loading leg 10, the heating leg 12, the transfer leg 14, and the return leg 16. The loading leg actuator 44 transfers a crucible 82 through the loading leg 10 to the entrance of the heating leg 12. The loading leg actuator 44 (see FIG. 1) is capable of pushing approximately 50 pounds, and it interfaces with the crucibles 82 through a flat pushing surface. Stroke length of the loading leg actuator 44 is about 34 inches. The loading leg actuator 44 positions the crucibles 82 within about 0.05 inches. The loading leg actuator 44 completes each push and return within about four seconds. When the heating system is continuously running, the temperature of the crucibles 82 as they pass through the loading leg 10 is approximately 600° C.

The heating leg actuator 46 (see FIG. 1) pushes each crucible 82 through the entrance of the heating leg 12, thereby moving the other crucibles 82 lined up within the heating leg 12 forward one crucible position. The heating leg actuator 46 is capable of pushing approximately 700 pounds, and it interfaces with the crucibles 82 through a flat pushing surface. Stroke length of the heating leg actuator 46 is about 12 inches. The heating leg actuator 46 positions the crucibles 82 within about 0.05 inches. The heating leg actuator 46 completes each push and return within about four seconds. When the heating system is continuously running, the temperature of the crucibles 82 at the entrance of the heating leg 12 is approximately 600° C.

The transfer leg actuator 42 (see FIG. 1) moves the transfer trolley 110 from the exit end of the heating leg 12 to the dump-chamber 6 and then back through the transfer leg 14 to the entrance of the return leg 16. The transfer leg actuator 42 is capable of pushing or pulling approximately 50 pounds, and it interfaces with the transfer trolley 110 through a mechanical locking action. Stroke length of the transfer leg actuator 42 is about 82 inches. The transfer leg actuator 42 positions the crucibles 82 within about 0.05 inches. The transfer leg actuator 42 completes each push and temporary retraction clear of the inner dump gate 36 within about five seconds. When the transfer leg actuator 42 pushes or pulls the transfer trolley 110, the crucibles 82 on the transfer trolley 110 are at full titanium alloy melt temperatures approaching 1,500° C.

The return leg actuator 48 (see FIG. 1) pushes the crucible 82 through the return leg 16 to the loading area. The return leg actuator 48 is capable of pushing approximately 250 pounds, and it interfaces with the crucibles 82 through a flat pushing surface. Stroke length of the return leg actuator 48 is about 72 inches. The return leg actuator 48 positions the crucibles 82 within about 0.05 inches. The return leg actuator 48 completes the push and returns within about three seconds. When the heating system is continuously running, the temperature of the crucibles 82 as they pass through the return leg 16 is approximately 1,400° C.

Figure 19:
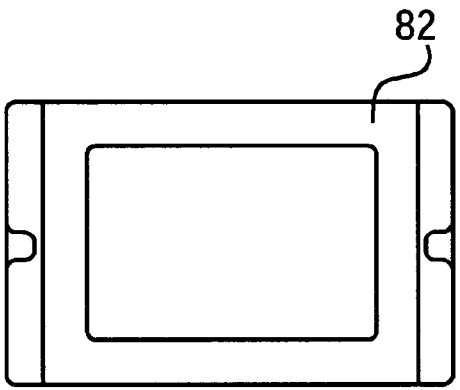
FIG. 19.—Represents another sectional view of the transfer crucible of FIGS. 15, 16, 17 and 18.
Figure 18:
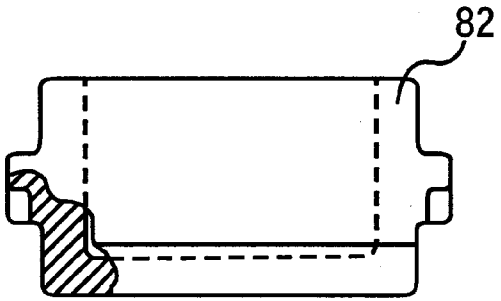
FIG. 18.—Represents another sectional view of the transfer crucible of FIGS. 15, 16, and 17.
Figure 17:
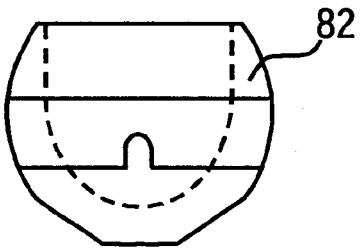
FIG. 17.—Represents another sectional view of the transfer crucible of FIGS. 15 and 16.
Figure 15:
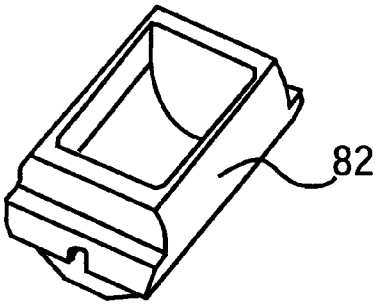
FIG. 15.—Depicts a view of a transfer crucible for use in the heating system of FIG. 1.
Figure 16:
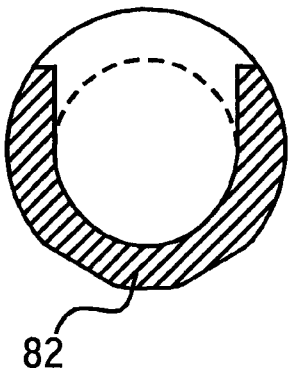
FIG. 16.—Represents a sectional view of the transfer crucible of FIG. 15.

In addition to the actuators for moving the crucibles 82, the heating system also has a crucible dump actuator (not shown) for inverting the transfer trolley 110 with the crucible 82 and hot billet 70 within the dump-chamber 6. The dumping action is performed by a stepper motor/gearbox 120 (see FIG. 12) directly driving the dump assembly. The transfer trolley 110 and loaded crucible are clamped in position, and then the assembly is rotated approximately 180 degrees to deliver the hot billet 70 to the forming means 8. The crucible dump actuator positions the transfer trolley 110 with the loaded crucible within about 0.5 degrees. The crucible dump actuator completes each dump and return rotation within three seconds. The rotation is sufficiently fast such that the partially liquid billet 70 does not fall out of the crucible 82 until the crucible is fully inverted. When the crucible dump actuator rotates the transfer trolley 110 with the loaded crucible, the crucible 82 is at full titanium alloy melt temperatures approaching 1,500° C. in one embodiment of the invention, the crucibles 82 (see FIG. 15) weigh up to approximately 18 pounds each. The crucibles 82 are about six inches in diameter (see FIG. 16) with flat bottoms for ease of movement on the crucible slide rails 85 (see FIG. 17), and are about ten inches in length (see FIGS. 18 and 19). The crucibles 82 are constructed of a castable alumina ceramic and capable of withstanding temperatures up to about 2,000° C. This material is selected for its high-temperature strength, low reactivity to hot titanium, good insulating characteristics, and shock resistance. This material may be somewhat brittle and prone to cracking, especially at titanium alloy melting temperatures approaching 1,500° C. Therefore, contact with the crucibles 82 is accomplished using broad, load-spreading end-effectors. To further improve performance of the crucibles, a composite construction may be used with a boron nitride inner liner to further reduce reactivity with titanium.

Vacuum System

The vacuum system evacuates air from all three chambers—the load-chamber 4, dump-chamber 6, and main chamber 2. Both the load-chamber 4 and the dump-chamber 6 have a compound vacuum gauge (not shown) capable of reading from about 1 psig to about $1\times10^{-4}$ torr. The vacuum gauge provides an analog output signal (including 0 to 10 Vdc or 4 to 20 mA) for monitoring by an external data acquisition system (not shown). All sealing surfaces, such as crushable copper gaskets and elastomer o-rings, minimize gas leakage rate. Access plates are located throughout the vacuum system for making adjustments to the crucible/billet transfer system mechanisms prior to production operation.

Figure 4:
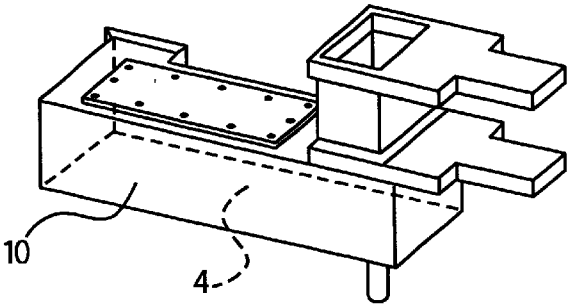
FIG. 4.—Represents another detailed view of the cold-billet load-chamber of FIGS. 2 and 3.
Figure 13:
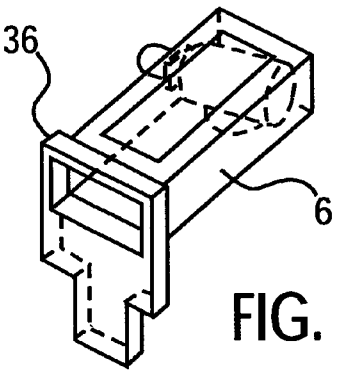
FIG. 13.—Represents another view of the hot-billet dump-chamber of FIGS. 11 and 12.

Each of the vacuum gates—the inner load gate 28, outer load gate 26, inner dump gate 36, and outer dump gate 34—operates as a pneumatic slide gate. The vacuum valves and vacuum gates are controlled by solenoid actuators that are triggered by output signals from the computing device. The vacuum gates provide fully-open and fully-closed limit switch signals. In accordance with one aspect of the present invention, the dimensions of the opening of the inner dump gate 36 are at least 8 inches by 14 inches to accommodate passage of the crucible 82 and billet 70 at maximum profile from the heating leg 12 to the dump-chamber 6 (see FIG. 13). The outer dump gate 34 opening is at least 5 inches by 7 inches (or eight inches in diameter) to pass the hot billet 70 in profile view from the dump-chamber 6 to the forming means 8. The inner load gate 28 opening is at least 7 inches by 11 inches to pass the crucible 82 and billet 70 in a downward direction from the load-chamber 4 to the loading leg 10 (see FIG. 4). The outer load gate 26 opening is at least 7 inches by 11 inches to accommodate passage of the billet 70 on its side to the load-chamber 4 (see FIG. 4), including enough room for the loading means that grip the billet 70, preferably grips on a robotic arm 130 (see FIGS. 20 and 21). Air pressure controlled by electrical solenoids (120 Vac or 24 Vdc) is used to operate these gates.

Figure 9:
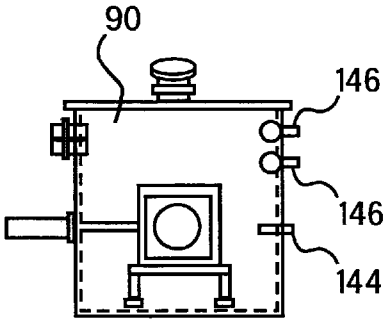
FIG. 9.—Represents another sectional view of the heating leg of FIGS. 7 and 8.

The heating system uses standard vacuum feedthroughs for electrical, cooling, and instrumentation devices. The feedthroughs are vacuum-rated to below $1\times10^{-4}$ torr. First, the heating leg 12 has two high-current (3,000 A rated) water-cooled feedthroughs 144 (see FIGS. 7 and 9) to supply electrical power to busbars that feed the individual induction heating coils 90. Second, two cooling paths (two supply and two return connections) cool the first two induction coils. One cooling path (one supply and one return connection) cools the remaining induction coils. All supply and return feeds are connected to headers 146 (see FIGS. 7 and 9) that are fed through the heating leg 12 wall. The two water feedthroughs have typical flow rates of 30 gal/min each. Third, sixteen type K thermocouples, one for each of the twelve induction heating coils 90 plus four more thermocouples for monitoring water temperature, monitor each induction heating coil 90 and water temperature. Thermocouple leads are fed through the heating chamber wall using two thermocouple feedthroughs 150 (see FIG. 7) having ten pairs of connections each. Billet 70 temperature is monitored using a type B thermocouple feedthrough with at least four pairs of supply and return connections. Finally, the temperatures of sixteen coolant flows are monitored in the heating leg 12: 14 flows for the individual flow paths to the induction heating coils 90, and the supply and return coolant flow from the main busbars. Therefore, two 20-pin general instrumentation feedthroughs (8 pairs plus two spares) 154 (see FIG. 7) are used.

Figure 8:
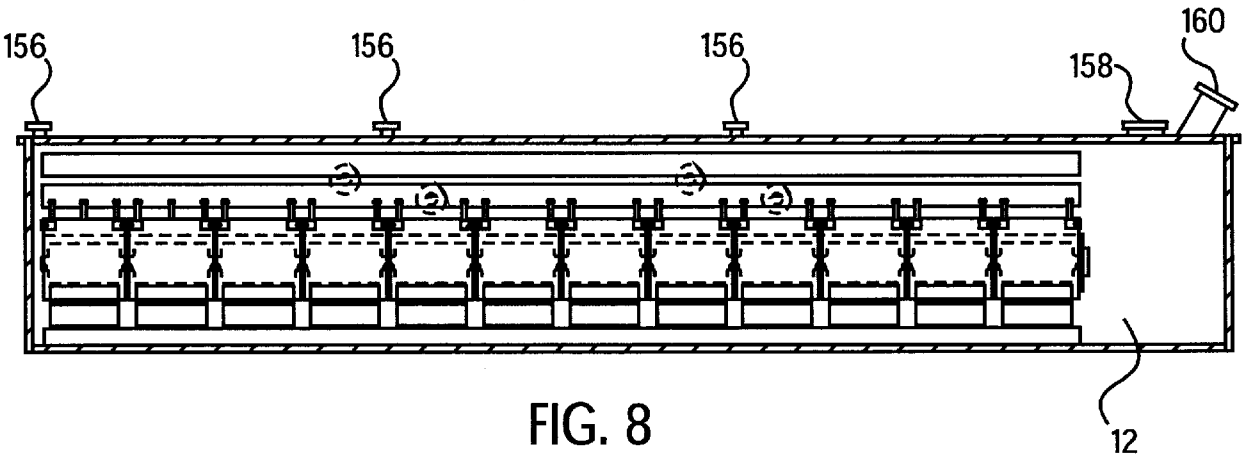
FIG. 8.—Represents a sectional view of the heating leg of FIG. 7.

Two viewing ports 156 (see FIG. 8) are located on the heating leg 12 in the region between induction coil segments and one viewing port 156 is located at the entrance of the heating leg 12. Another viewing port 158 is located at the outlet of the heating leg 12. The viewing port hardware is vacuum-compatible and the viewing area is approximately 0.625 inches to about 1.0 inches in diameter. The viewing port 158 at the outlet of the heating leg 12 is directed down at the point where the loaded crucible emerges from the induction heating coils 90 and is transferred onto the transfer trolley 110. The window material of the viewing ports is a material such as wide angle glass or sapphire that can withstand temperatures above 200° C. and radiant heat conditions.

Two connections (not shown) exhaust cover gas to the gettering system 40 and feed in purified gas from the gettering system 40. A spare evacuation port with a blanked flange on the main chamber 2 enables possible future connection to a high vacuum valve for evacuation of the entire main chamber 2 during melting of billets 70.

Inert Gas System

The inert gas is delivered through stainless steel tubing with means for connecting the tubing to the main chamber 2 wall ports, preferably through Conflat flanges. The tubing has at least one feed and one return. The blower circulates the cover gas inside the chambers and through the gettering system 40. The inert gas is supplied to the inductin heating system through portable bottles in a rack near the heating system. The inert gas is preferably argon with a purity of at least 98%. The pressure is regulated to a typical value of 0.1 psig to maintain positive pressure when a billet 70 is either added to the load chamber 4 or removed from the dump chamber 6. Total volume expansion is typically less than 2%.

The inert gas is cleaned of as many impurities as possible to prevent diffusion into the billet 70. The gettering system 40, preferably a commercially-available titanium gettering system 40, removes the residual gases to a level less than 1 ppm. Oxygen, nitrogen, and water vapor are all removed to a level of at least $1\times10^{-6}$ ppm. For a titanium gettering system 40, the titanium charge is periodically replaced when impurity levels begin to rise. Gas monitoring equipment is capable of measuring impurities in the inert gas to a level of at least $1\times10^{-6}$ ppm of oxygen. A visual display shows current system impurity level. The gas monitoring equipment provides an analog output signal (including 0 to 10 Vdc or 4 to 20 mA) for monitoring by the data acquisition system.

Typical inert gas flow rate in the gettering system 40 is approximately 40 l/min. A gas flow indicator (not shown)

connects the gettering system 40 to a load-chamber vacuum inlet port (not shown). The gas flow indicator provides an analog output signal (including 0 to 10 Vdc or 4 to 20 mA) for monitoring by the data acquisition system. A regulator in the gettering system 40 controls pressure and prevents over-pressure in the gettering system 40. The data acquisition system receives analog outputs from the gettering system 40 for the gas flow rate and the impurity level. An alarm limit of $1\times10^{-5}$ ppm in the output gas stream from the gettering system 40 is set in the monitoring equipment controls. An audible alarm is preferred.

Induction Heating System

An induction heating system heats the billets 70 within the heating leg 12. The induction heating system is comprised of induction heating equipment that is commercially available. The induction heating equipment includes a 300 kW power supply 132 (see FIGS. 20 and 21), a load matching station 134 (see FIGS. 20 and 21), a coil stack comprised of twelve individual induction heating coils 90 (see FIG. 7) stacked horizontally to form a tube, and a cooling water supply system. Electrical and cooling water connections from the load matching station 134 to the heating leg 12 are made with dry-break, quick-disconnect (preferably all brass or all stainless steel) fittings to allow the heating system to be rapidly disconnected and rolled away from the forming means 8.

The billets 70 are heated by induction heating coils 90 (see FIGS. 22 through 25) located within the heating leg 12. The induction heating coils 90 are made of hollow copper tubing with cooling water circulating within. The coils are embedded in a cast refractory casing. The casing provides electrical and thermal insulating properties to the coils. Hardware for support of the induction heating coils 90 is capable of handling temperatures up to 100° C. The induction heating coils 90 are spaced 10.0 inches apart, center-to-center, in a horizontal tube configuration. Electrical power connections to the induction heating coils 90 are provided by one feedthrough 144 on the heating leg 12. Two additional feedthroughs 146 provide cooling water lines to the induction heating coils 90 inside the heating leg 12. The induction heating coils 90 are placed on mounting rails made of a material that is non-magnetic and non-conductive. Any conductive materials used in the heating leg 12 are positioned at least four inches away from the outer surface of the induction heating coils 90 to avoid excessive induction heating losses. A removable top plate on the heating leg 12 facilitates removal of individual induction heating coils 90 for maintenance and repair. The top plate has lifting lugs to aid in removal.

The induction heating power supply 132 is capable of 300 kW power output. The power supply 132 is capable of frequencies between about 10 and about 25 kHz. The computing device provides a 0 to 10 Vdc or 4 to 20 mA analog input signal to the power supply 132 representing a command for 0 to 100% power output. The power supply 132 provides 0 to 5 Vdc analog output signals representing capacitor voltage, output current, frequency, coil voltage, and heat station power. The signals are monitored through the computing device and the data acquisition system.

The load matching station 134 provides the interface between the induction heating power supply 132 and the induction heating coils 90. The load matching station 134 is built with manually placed, bolted capacitor/transformer jumpers. Because the heating system is conventional, details of the busbars and cable connections to connect the load matching station 134 to the induction heating coils 90 inside the heating leg 12, which may be used herein, have been omitted.

Because of the significant heating load from the induction heating coils 90 on the billets 70 and subsequent radiation from the billets 70 to inside coil refractory surfaces, the exteriors of the walls of the main chamber 2 are cooled. The induction heating power supply 132 is built for a capacity of about 300 kW with a duty cycle of 100%, but most of the lost energy is convected out of the chamber by internal water cooling. Waste heat is removed by an existing plant chilled water loop. The chilled water loop provides cold water at approximately 56 psi and 45° F. Return line pressure is approximately 34 psi (i.e., a 22 psi differential). Flow of chilled water is controlled by means such as a thermostatically controlled water solenoid or flow control valve.

All equipment associated with the heating system has power feeds connected to a common 480-volt 3-phase power source. According to one embodiment of the present invention, the computing device is a programmable logic controller (PLC) that controls the entire heating system. The PLC input/output (I/O) hardware resides within an existing second (empty) rack in an existing control panel. The I/O hardware is controlled as remote units from the PLC. Because the PLC is conventional, details of the PLC I/O rack, power supply for all modules in the rack, and remote I/O adapter module, which may be used herein, have been omitted. All discrete (on/off) logic signals both to and from the system are 24 Vdc or 120 Vac. All electrical power and control components are within NEMA 12 enclosures.

Safety Components

To ensure operator safety, door interlocks are installed where necessary. Emergency stop push-button circuits are implemented with additional contacts for use in external equipment. E-stop circuits are wired to directly remove power from all systems which have potentially harmful motion or power outputs. The induction heating system has an additional safety shutdown input circuit for connection of external safety contacts. Sensors disposed about the induction heating system monitor for unsafe operating conditions for equipment and personnel. The computing device monitors these inputs and shuts down the system to protect the equipment and operator for situations including the following: (1) loss of cooling water pressure/flow; (2) high water temperature; (3) low cooling water reservoir levels; (4) dangerous power levels; and (5) high pressure in the chambers.

System Support Structure

Figure 26:
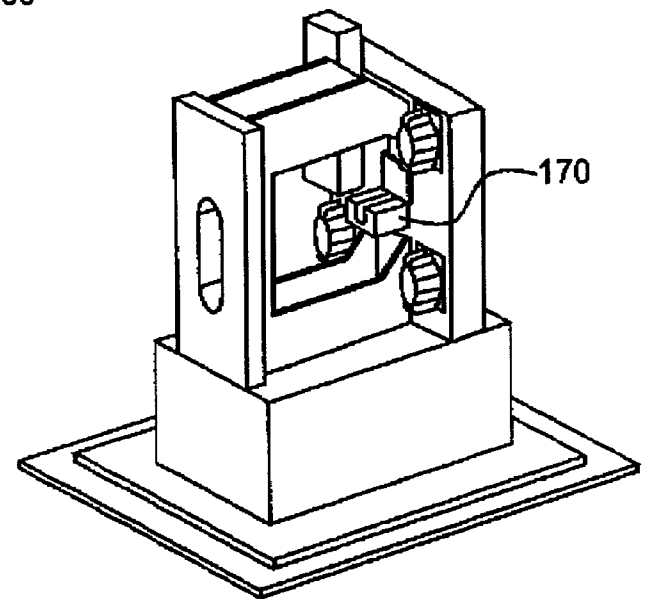
FIG. 26.—Represents a version of the C-frame area of the forming system to which the heating system of FIG. 1 is coupled.
Figure 24:
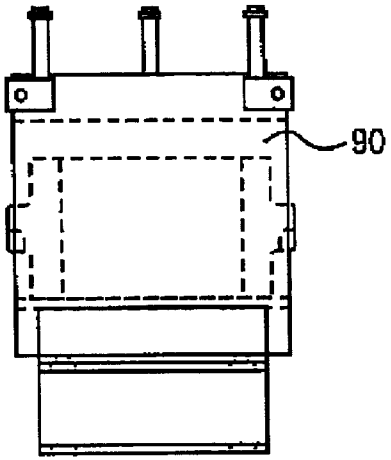
FIG. 24.—Represents a sectional view of the induction heating coil of FIGS. 22 and 23.
Figure 25:
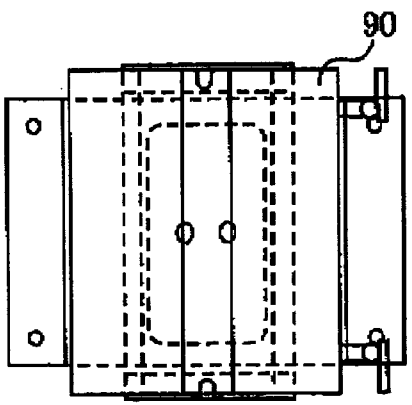
FIG. 25.—Represents another sectional view of the induction heating coil of FIGS. 22, 23, and 24.
Figure 22:
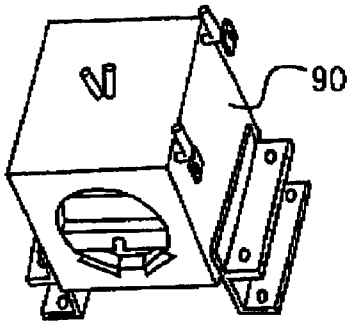
FIG. 22.—Depicts an induction heating coil for use in the heating system of FIG. 1 and in the induction heating coil stack of FIGS. 5 and 6.

The induction heating system support structure 50 (see FIG. 1) is a semi-mobile unit to provide longitudinal and lateral movement relative to the forming means 8 so that the existing loading means and a meltpot can be used for semi-solid and liquid aluminum casting. The structure 50 sits on air pallets with quick disconnects for roll-in/roll-out operation. In accordance with one aspect of the present invention, the induction heating system is split at a breakpoint located at the inner dump gate 36 for installation and removal of the induction heating system. The dump-chamber 6 is mounted to the forming means 8 first (for a die casting machine used as the forming means, the dump-chamber 6 is mounted to a shot sleeve 170 (see FIG. 26)), then the balance of the induction heating system is moved up to the dump chamber/forming means 8 and bolted in place. The support structure 50 has means for leg height adjustment to allow proper alignment and attachment/detachment at the induction heating system breakpoint.

Having thus described several exemplary embodiments of the invention, it will be apparent that various alterations, modifications, and improvements will readily occur to those skilled in the art. For example, other equivalent configura-tions may produce different vacuum levels, using different inert gases and different flow rates and pressures. Such alterations, modifications, and improvements, though not expressly described above, are nonetheless intended and implied to be within the spirit and scope of the invention. Accordingly, the foregoing discussion is intended to be illustrative only; the invention is limited and defined only by the following claims and equivalents thereto.

What is claimed is:

1. A system for heating metal billets comprising:

(a) a heating chamber;

(b) a cold billet load chamber;

(c) means for substantially evacuating air from the cold billet load chamber and the heating chamber, said means for substantially evacuating air being fluidly coupled to said cold billet load chamber and said heating chamber;

(d) means for supplying an inert gas into the heating chamber, said means for supplying an inert gas being fluidly coupled to said heating chamber;

(e) means for removing impurities from the inert gas, said means comprising a gettering system, said gettering system being fluidly coupled to the heating chamber;

(f) means for transporting the metal billets through the heating chamber;

(g) means for maintaining inert gas in the heating chamber, said means comprising a first vacuum gate and a second vacuum gate, said first vacuum gate allowing metal billets to be placed in the cold billet load chamber when said first vacuum gate is open and providing a hermetic seal when said first vacuum gate is closed, and said second vacuum gate maintaining inert gas in the heating chamber when said second vacuum gate is closed; and (h) means for heating the billets in the heating chamber.

2. The system according to claim 1 wherein the means for heating the billets in the heating chamber comprises a plurality of induction heating coils disposed inside said heating chamber for heating the billets.

3. The system according to claim 1 wherein the means for transporting the billets through the heating chamber comprises:

(a) a slide rail extending through the heating chamber;

(b) a plurality of trolleys slidably disposed on the slide rail; and (c) a plurality of carriers mounted on the plurality of trolleys.

4. The system according to claim 3 wherein the plurality of carriers are crucibles comprised of alumina ceramic and said crucibles are capable of withstanding temperatures of at least about 2000 degrees centigrade.

5. The system according to claim 1 further comprising a hot billet dump chamber for receiving heated billets, said hot billet dump chamber being coupled to said heating chamber.

6. The system according to claim 5 further comprising a casting machine coupled to the hot billet dump chamber for casting the metal billets.

7. The system according to claim 1 further comprising:

(a) a cold billet load chamber;

(b) a loading chamber;

(c) a transfer chamber; and (d) a return chamber; wherein said cold billet load chamber is disposed between and connected to said loading chamber and said return chamber, said loading chamber is disposed between and connected to said cold billet load chamber and the heating chamber, said heating chamber is disposed between and connected to said loading chamber and said transfer chamber, said transfer chamber is disposed between and connected to said heating chamber and said return chamber, and said return chamber is disposed between and connected to said cold billet load chamber and said transfer chamber, so as to form a continuous system.

8. The system according to claim 7 wherein:

(a) the means for substantially evacuating air from the heating chamber is capable of substantially evacuating air from the loading chamber, heating chamber, transfer chamber and return chamber; and (b) the means for supplying an inert gas into the heating chamber is capable of supplying the inert gas to the loading chamber, heating chamber, transfer chamber and return chamber.

9. The system according to claim 8 further comprising means for maintaining the inert gas in the loading chamber, transfer chamber and return chamber.

10. A system for heating metal billets comprising:

(a) a heating chamber;

(b) a cold billet load chamber;

(c) a loading chamber;

(d) a transfer chamber;

(e) a hot billet dump chamber;

(f) a return chamber;

(g) means for substantially evacuating air from the cold billet load chamber, loading chamber, heating chamber, transfer chamber and return chamber, said means for substantially evacuating air being fluidly coupled to said heating chamber, cold billet load chamber, loading chamber, transfer chamber and return chamber;

(h) means for supplying an inert gas into the loading chamber, heating chamber, transfer chamber and return chamber, said means for supplying an inert gas being fluidly coupled to said loading chamber, heating chamber, transfer chamber and return chamber;

(i) means for maintaining inert gas in the heating chamber, said means comprising a first vacuum gate and a second vacuum gate, said first vacuum gate allowing metal billets to be placed in the cold billet load chamber when said first vacuum gate is open and providing a hermetic seal when said first vacuum gate is closed, and said second vacuum gate maintaining inert gas in the heating chamber when said second vacuum gate is closed;

(j) means for removing impurities from the inert gas, said means comprising a gettering system, said gettering system being fluidly coupled to said heating chamber;

(k) a slide rail extending through the heating chamber, a plurality of trolleys slidably disposed on the slide rail, and a plurality of carriers mounted on the plurality of trolleys for transporting the metal billets through the heating chamber, and (l) a plurality of induction heating coils disposed inside said heating chamber for heating the billets; wherein said cold billet load chamber is disposed between and connected to said loading chamber and said return chamber, said loading chamber is disposed between and connected to said cold billet load chamber and the heating chamber, said heating chamber is disposed between and connected to said loading chamber and said transfer chamber, said hot billet dump chamber is coupled to said heating chamber, said transfer chamber is disposed between and connected to said heating chamber and said return chamber, and said return chamber is disposed between and connected to said cold billet load chamber and said transfer chamber, so as to form a continuous system.

11. A process for heating metal billets using a system according to claim 1, said process comprising the steps of:

(a) substantially evacuating air from the heating chamber;

(b) supplying an inert gas into the heating chamber;

(c) transporting a metal billet into the heating chamber;

(d) heating the metal billet in the heating chamber;

(e) removing impurities from the inert gas;

(f) transporting the metal billet out of the heating chamber; and (g) maintaining inert gas in the heating chamber while transporting the metal billet into the heating chamber, and while heating the metal billet in the heating chamber, and while transporting the metal billet out of the heating chamber.

12. The process according to claim 11 wherein the step of transporting the metal billet into the heating chamber is comprised of the step of transporting the metal billet from a loading chamber connected to the heating chamber, said loading chamber containing inert gas.

13. The process according to claim 11 wherein the step of transporting the metal billet out of the heating chamber is comprised of the step of transporting the metal billet from the heating chamber to a hot billet dump chamber connected to the heating chamber, said hot billet dump chamber containing inert gas.

14. The process according to claim 11, wherein the step of heating the metal billet is comprised of the step of heating the metal billet using an induction heating coil.

15. The process according to claim 11 further comprising the step of transporting the heated metal billet from the heating chamber to a means for forming the heated metal billets.

16. The process according to claim 11 further comprising the step of transporting the heated metal billet from the heating chamber to a means for forming the heated metal billets; wherein, the step of transporting the metal billet into the heating chamber is comprised of the step of transporting the metal billet from a loading chamber connected to the heating chamber, said loading chamber containing inert gas; the step of transporting the metal billet out of the heating chamber is comprised of the step of transporting the metal billet from the heating chamber to a hot billet dump chamber connected to the heating chamber, said hot billet dump chamber containing inert gas; and the step of heating the metal billet is comprised of the step of heating the metal billet using an induction heating coil.

* * * * *